US007299929B2

(12) United States Patent
Yokota et al.

(10) Patent No.: US 7,299,929 B2
(45) Date of Patent: Nov. 27, 2007

(54) CLOSED AIR FORCE TYPE GRAIN SORTING MECHANISM

(75) Inventors: Kouji Yokota, Okayama (JP); Tadashi Hamaguchi, Okayama (JP)

(73) Assignees: Seirei Industry Co., Ltd., Okayama (JP); Yanmar Agricultural Equipment Co., Ltd., Osaka (JP)

( * ) Notice: Subject to any disclaimer, the term of this patent is extended or adjusted under 35 U.S.C. 154(b) by 221 days.

(21) Appl. No.: 10/467,152

(22) PCT Filed: May 28, 2001

(86) PCT No.: PCT/JP01/04476

§ 371 (c)(1),
(2), (4) Date: Nov. 6, 2003

(87) PCT Pub. No.: WO02/064256

PCT Pub. Date: Aug. 22, 2002

(65) Prior Publication Data

US 2004/0065592 A1 Apr. 8, 2004

(30) Foreign Application Priority Data

Feb. 16, 2001 (JP) ..... 2001-040612

(51) Int. Cl.
*B07B 4/02* (2006.01)

(52) U.S. Cl. ..... 209/135; 209/137

(58) Field of Classification Search ..... 209/135, 209/134, 27, 136, 24, 26, 137, 28, 33, 32, 209/34, 35; 241/9, 47

See application file for complete search history.

(56) References Cited

U.S. PATENT DOCUMENTS 3,701,420 A * 10/1972 Satake ..... 209/135
6,561,445 B2 * 5/2003 Yamamoto et al. ..... 241/47

FOREIGN PATENT DOCUMENTS

| | | |
|---|---|---|
| JP | U 25-1846 | 3/1950 |
| JP | 38-21188 | 10/1963 |
| JP | 52-50187 | 12/1977 |
| JP | U 1-156749 | 10/1989 |
| JP | 04-271851 | 9/1992 |
| JP | 10-192722 | 7/1998 |
| JP | 11-319718 | 11/1999 |
| JP | 2002143698 A * | 5/2002 |

* cited by examiner

*Primary Examiner*—Patrick Mackey
*Assistant Examiner*—Kaitlin S Joerger
(74) *Attorney, Agent, or Firm*—Knobbe, Martens, Olson & Bear

(57) ABSTRACT

A grain dropping passage constituted below a husking unit(D) serves as a winnowing room(A). A winnowed grain conveyor(1) is provided as the sole conveyor below the winnowing room(A). A winnowing wind blown by a winnowing fan(F) through a blowing room(B) passes through below the winnowed grain conveyor(1) and then rises in the winnowing room(A). The grains mixed with hulls and others are winnowed in the winnowing room(A) so as to be sorted into two kinds: winnowed grains to be received by the winnowed conveyor(1), and the other including hulls to be received by a hull conveyor(2) arranged oppositely to the winnowed grain conveyor(1) with respect to the winnowing fan(F). In this manner, powerful separation can be executed by means of winnowing wind having a large amount and large speed so as to improve a winnowing ability remarkably.

5 Claims, 19 Drawing Sheets

Winnowing drive motor: 4P, 200 V, 1.5 kw, rating 1710 rpm, 6.2 A (60 Hz)

Wind speed measurement result Inverter: 51.5 Hz,

Fan rotational number: 1247 $min^{-1}$

Wind control valve: half opened (33 mm open)

| | Rear ← | | | | → Front | Average |
|---|---|---|---|---|---|---|
| 1 | 1.8 | 1.9 | 2.3 | 1.9 | 2.3 | 2.0 |
| 2 | 4.2 | 4.4 | 4.0 | 3.3 | 3.5 | 3.9 |
| 3 | 4.3 | 4.4 | 4.0 | 4.6 | 4.0 | 4.3 |
| 4 | 4.8 | 4.5 | 3.9 | 4.4 | 4.0 | 4.3 |
| 5 | 5.2 | 6.0 | 5.4 | 6.3 | 4.8 | 5.5 |
| 6 | 5.5 | 5.8 | 5.1 | 6.0 | 5.2 | 5.5 |
| 7 | 4.6 | 4.4 | 4.1 | 4.8 | 4.5 | 4.5 |
| 8 | 6.0 | 6.0 | 5.8 | 7.5 | 6.4 | 6.3 |
| 9 | 4.8 | 4.8 | 4.6 | 6.4 | 4.0 | 4.9 |
| 10 | 5.6 | 4.4 | 3.5 | 3.5 | 4.0 | 4.2 |
| 11 | 6.0 | 6.2 | 5.2 | 5.5 | 6.0 | 5.8 |
| 12 | 6.6 | 6.2 | 6.1 | 6.0 | 6.2 | 6.2 |
| 13 | 6.8 | 6.5 | 6.0 | 7.2 | 6.8 | 6.7 |
| 14 | 3.2 | 3.5 | 2.8 | 5.0 | 5.5 | 4.0 |
| 15 | 3.8 | 5.5 | 3.3 | 6.0 | 6.5 | 5.0 |
| Average | 4.9 | 5.0 | 4.4 | 5.2 | 4.9 | |

Prior Art

Fig.22

| | | Wind amount $m^3/s$ |
|---|---|---|
| Left side of the grain dropping passage | Winnowing wind passage 44 (clearance between the horizontal air course blocking plate 34 and an inner wall) | 35 |
| | Winnowing wind passage between the horizontal air course blocking plate 34 and the left-side triangular grain-flow wind blocking plate 10 | 10 |
| | Winnowing wind passage between the left-side triangular grain-flow wind blocking plate 10 and the outward grain-flow plate 31 | 25 |
| Right side of the grain dropping passage | Winnowing wind passage between the grain-flow plate 42 and the right-side upper triangular grain-flow wind blocking plate 8 | 31 |
| | Winnowing wind passage between the right-side upper triangular grain-flow wind-blocking plate 8 and the right-side lower triangular grain-flow wind blocking plate 7 | 20 |
| | Winnowing wind passage between the right-side lower triangular grain-flow wind blocking plate 7 and the inward grain-flow plate 43 | 21 |

CLOSED AIR FORCE TYPE GRAIN SORTING MECHANISM

CROSS-REFERENCE TO RELATED APPLICATIONS

This application is the U.S. National Phase under 35 U.S.C. § 371 of International Patent Application PCT/JP01/04476, filed May 28, 2001, which claims priority of Japanese Patent Application No. 2001-40612, filed Feb. 16, 2001. The International Application was published under PCT Article 21(2) in a language other than English.

FIELD OF THE INVENTION

The present invention relates to a closed air force type grain sorting mechanism (a closed winnowing system) which separates grains from hulls and others after husking so as to sort winnowed grains from hulls and others.

BACKGROUND OF THE INVENTION

A closed winnowing system located below a husking device is conventionally well-known, as disclosed in Japanese Patent Publications No. 21188 (1963) and No. 50187 (1977), for example.

FIG. 21 shows such prior art apparatus in detail. In accordance with the prior art, a closed winnowing system is located below a husking unit D including a grain hopper 23 and husking rolls 20 and 21. In the winnowing system, two outlets are provided below the winnowing room A'. One is a first outlet 24 where winnowed grains (including husked grains and unhusked grains) fall, and the other is a second outlet 25 where lightweight particles such as fruitlessness and crashed grains being blown up fail.

Further, a third outlet 26 where extremely lightweight hulls being blown away fall is provided at a reverse position of the blowing room B with respect to the winnowing fan F.

After winnowing, the winnowed grains, lightweight particles and hulls are sorted into three outlets: "the first outlet 24 where winnowed grains fall"; "the second outlet 25 where lightweight particles (fruitlessness, crashed grains and the like) being blown up fall"; and "the third outlet 26 where hulls being blown away fall".

However, such sorting method has been available at a time when lightweight crashed grains and the like fallen from the second outlet 25 were taken seriously as feeding stuff for livestock and poultry. In recent years, the necessity of "the second outlet 25 where lightweight particles being blown up fall" has been decreased.

Further, in this manner, a flow of winnowing wind must be guided so as to sort winnowed grains and lightweight particles between the first outlet 24 and the second outlet 25. As a result, the winnowing wind can not set to be strong. Accordingly, a separation capacity is decreased, so that a husking process capacity of the husking unit D is also decreased whereby a malfunction in which a husking and winnowing process of large capacity can not be executed at a short time has been occurred.

In a view of mentioned above, an object of the present invention is to provide a closed grain winnowing system constituted so as to sort winnowed grains and others into only two outlets of "a winnowed grain conveyor" and "a hull conveyor" after the winnowing.

SUMMARY OF THE INVENTION

According to the present invention, a closed air force type grain sorting mechanism (a closed winnowing system) having a grain dropping passage serving as a winnowing room below a husking unit, wherein a winnowing fan blows a winnowing wind through a blowing room into the lower end of the winnowing room. A winnowed grain conveyor is provided as the sole conveyor (outlet) positioned below the winnowing room. A hull conveyor is provided at a reverse position of the winnowing room with respect to the winnowing fan. A mixture of grains, hulls and others falling from the husking unit are separated into two groups: one for winnowed grains to be received by the winnowed grain conveyor, and the other for hulls and lightweight particles to be received by the hull conveyor. In this manner, powerful separation can be executed by means of winnowing wind having a large amount and large speed as compared with a conventional case in which the winnowed grains and others are sorted into the three outlets.

The present invention is also constituted so as to provide the winnowing room and the blowing room adjacently to each other through a shield plate. The winnowing fan is provided within the blowing room so as to blow the winnowing wind to a downward portion of the winnowing room through the blowing room. The shield plate provided between the winnowing room and the blowing room is vertically constituted. The winnowing room is provided along the shield plate so as to be vertically linear. The winnowed grain conveyor is provided in the lower end of the vertically linear winnowing room so as to allow the winnowing wind to pass through below the winnowed grain conveyor and to blow up for the winnowing room. In this manner, the grains and others falling in the grain dropping passage can be separated by the winnowing wind vertically blown up, thereby improving a winnowing accuracy to improve a winnowing ability.

Further, in accordance with the present invention, a winnowing wind shutter adjusting a speed and amount of the winnowing wind supplied in the winnowing room is provided in a passage which returns part of the air discharged from the winnowing fan to a hull blowing wind passage. In this manner, (unlike a ratio of the winnowing wind flowing into the winnowing room is conventionally changed by a first outlet wind amount adjusting shutter and a second outlet wind amount adjusting shutter) since the wind amount flowing from the blowing room to the winnowing room is uniquely adjusted, the wind amount adjustment can be executed accurately. Accordingly, there is no need to station a skilled operator because the adjustment of the winnowing wind can be executed easily by any worker, whereby the winnowing accuracy can be improved.

Further, in the winnowing room is provided at least one sectionally triangularly shaped plate serving as a grain guide plate as well as a winnowing wind guide plate. Faces (normally, two faces) of the triangular plate with which dropping grains collide are used to guide the grains. Such triangular plate also serves as a reinforcing plate increasing the strength of the winnowing apparatus.

In addition, the winnowing fan is constituted by right and left fans, and a winnowing wind direction adjusting plate onto which the winnowing wind from the winnowing fan is applied is provided in a lower portion of the blowing room. In this manner, the winnowing wind generated by the right and left fins is fully diffused in a closed housing so as to be capable of setting as an uniform winnowing wind. In this manner, the winnowing accuracy and the winnowing ability can be also improved.

Further, a winnowing wind shutter plate for adjusting the winnowing wind amount is provided in a blow-off side of the winnowing fan so as to release the winnowing wind from the winnowing wind fan to the hull conveyor side. In this manner, the power of the winnowing wind adjusted by adjusting the amount of wind released from the blowing room to the hull blowing wind passage instead of adjusting the direction of the wind within the blowing room according to the conventional manner. Accordingly, the power of the winnowing wind can be set suitably and easily, thereby improving the winnowing ability.

BRIEF DESCRIPTION OF THE DRAWINGS

FIG. 4 is an enlarged front view of the closed winnowing system while

FIG. 22 is a table of wind amounts at various portions in the closed casing of the closed winnowing system according to the present invention.

DETAILED DESCRIPTION OF THE PREFERRED EMBODIMENT

With reference to the attached drawings, the present invention will be described in detail.

Figure 19:
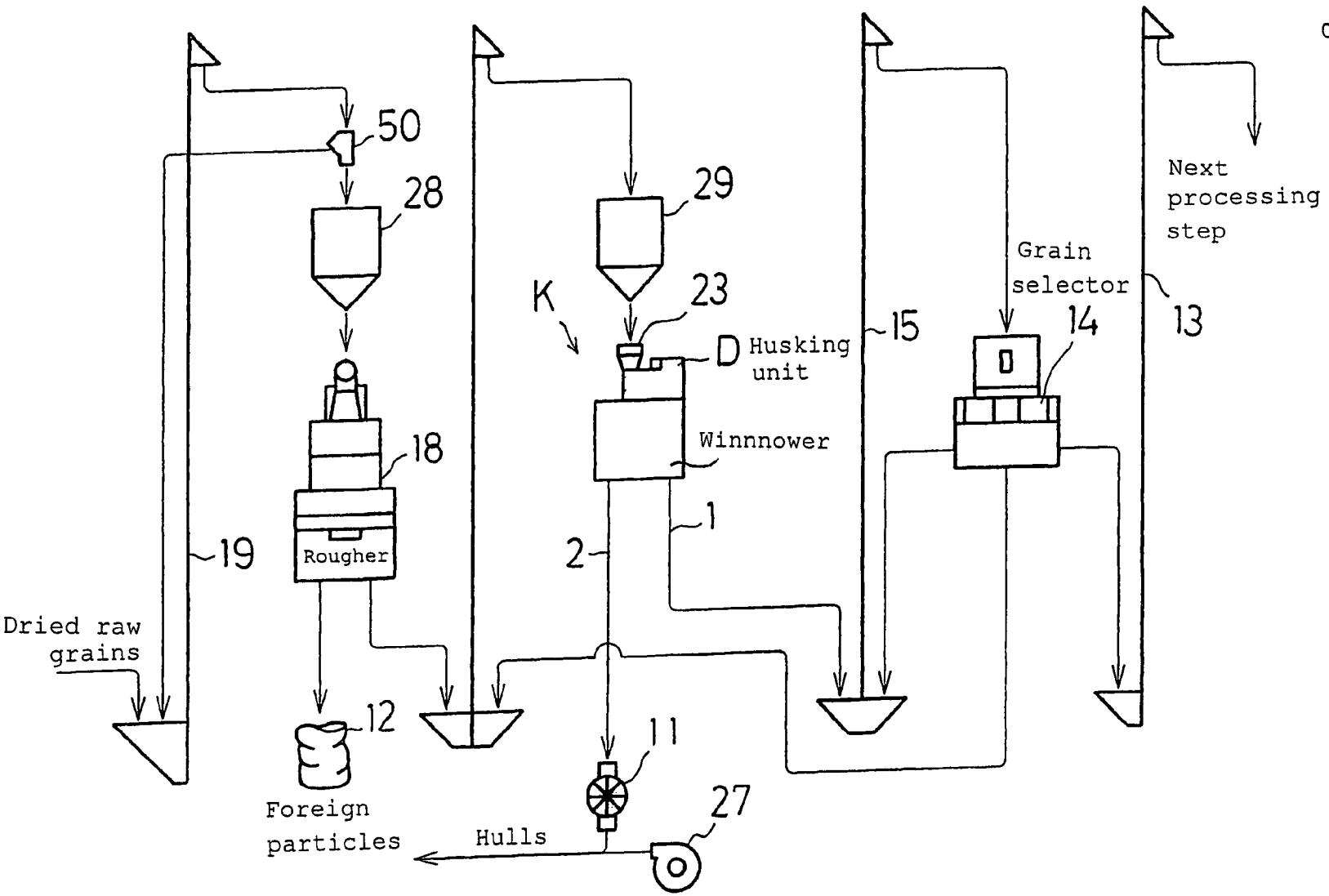
FIG. 19 is a block diagram of a grain husking-and-separating plant into which the closed winnowing system according to the present invention is incorporated.
Figure 20:
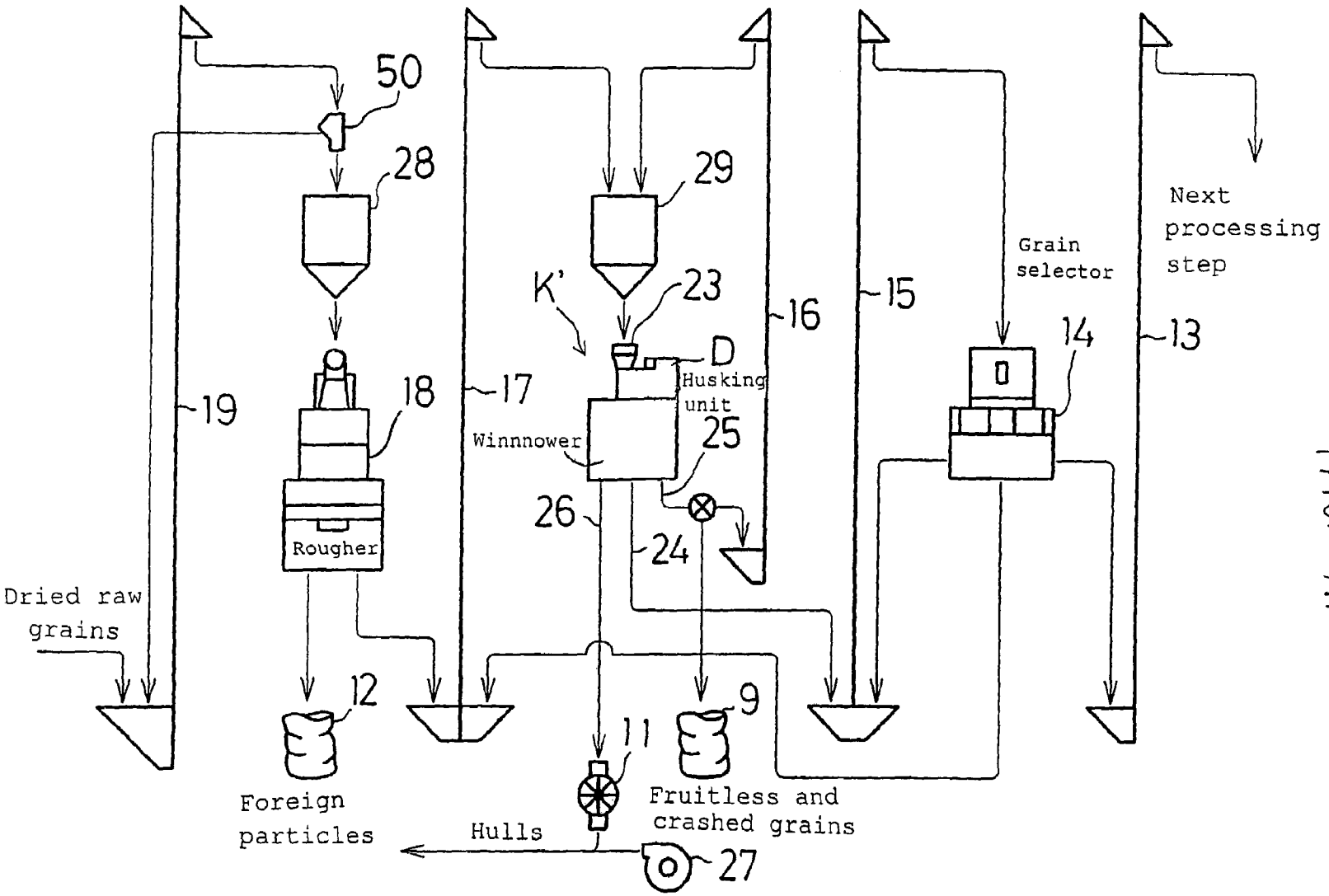
Fig.20 Prior Art
FIG. 20 is a block diagram of a grain husking-and-winnowing plant into which a conventional closed winnowing system is incorporated.

At first, referring to FIGS. 19 and 20, functions required of a closed winnowing system according to the present invention in a grain husking-and-winnowing plant are described in contrast to a conventional closed winnowing system.

FIG. 20 shows a flow of processes executed with the conventional grain husking-and-winnowing plant. Firstly, dried raw grains are thrown into a lower hopper located at a foot of a raw grain feeding elevator 19, and then this elevator is operated to put these dried raw grains into a roughing-out flow adjustment tank 28. If some of the grains brim over after filling the roughing-out flow adjustment tank 28, then a switching shutter 50 is operated to switch the flow of the grains so that the over-flown grains are directed to return to the lower hopper of the raw grain feeding elevator 19.

The dried raw grains in the roughing-out flow adjustment tank 28 are then fed into a rougher 18, which separates and removes foreign particles and contaminants such as straws and pebbles. These foreign particles are led to a foreign particle removal port 12.

Figure 21:
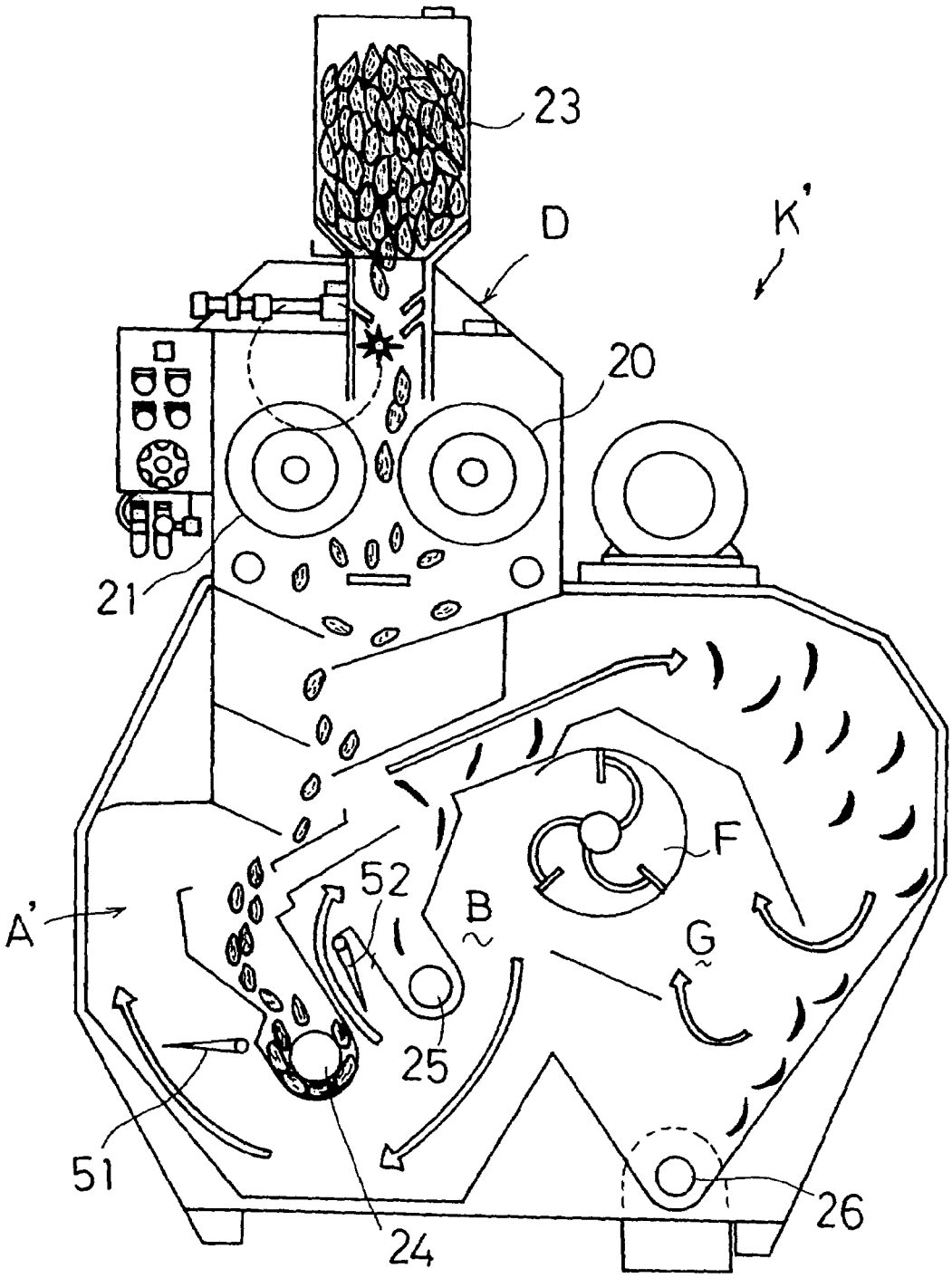
FIG. 21 is a sectional front view of the conventional closed winnowing system

The dried raw grains that are removed of foreign particles and contaminants are then led into a winnower bound elevator 17, which brings the raw grains up into an adjusting tank 29. The raw grains are then fed from the adjusting tank 29 to the hopper 23 of the closed winnowing system K'. As shown in FIG. 21, the conventional closed winnowing system K' has three outlets: "a first outlet 24 where winnowed grains fall"; "a second outlet 25 where lightweight particles such as fruitlessness, crashed grains being blown up fall"; and a "third outlet 26 where hulls being blown away fall".

As shown in FIG. 20, the grains which have fallen in the first outlet 24 are led to a grain selector 14. To improve the separation precision of the plant, this grain selector 14 separates the winnowed grains that have been separated by the winnowing system K' again into three groups: husked grains; mixture of husked and unhusked grains; and unhusked grains still having hulls. The group of husked grains sorted by the grain selector 14 are then directed to a next processing stage elevator 13, which brings the husked grains to the next processing stage, for example, into a storage tank, or to a packing process.

The group of mixture of husked and unhusked grains are fed into the hopper of the grain selector bound elevator 15, which supplies the grains to a second grain selector 14. To improve the separation precision of the plant, this grain selector 14 separates the winnowed grains that have been separated by the winnowing system K' again into three groups: husked grains; mixture of husked and unhusked grains; and unhusked grains still having hulls. The group of husked grains sorted by the grains selector 14 are then directed to a next processing stage elevator 13, which brings the husked grains to the next processing stage, for example, into a storage tank, or to a packing process.

The group of mixture of husked and unhusked grains are fed into the hopper of the grain selector bound elevator 15 and separated again by the grain selector 14. The group of unhusked grains are returned to the winnower bound elector 17, which is positioned prior to the closed winnowing system K, and are husked again by the husking unit D.

If the grain selector 14 does not sort the grains effectively and sufficiently, the resultant grains mixed with crashed grains, fruitless and the like is returned into the hopper of the grain selector bound elevator 15 and processed again by the grain selector 14.

Furthermore, the lightweight particles such as crashed grains and fruitlessness that have been blown upward and fallen into the second outlet 25 are led either directly to a poor grain reservoir 9 or to a winnower rebound elevator 16 according to the switching operation of a switching shutter mechanism. The winnower rebound elevator hinges 16 brings these poor grains again to the closed winnowing system K' for reprocessing.

The hulls that have been blown over a distance and have fallen into the third outlet 26 are led through a hull shutter 11 and carried and discharged by a wind generated by an exhausting fan 27 to the outside of the plant. The hull shutter 11 functions to prevent the discharging wind from entering the closed winnowing system K' and also to prevent the winnowing wind generated by the winnowing fan F of the winnowing system K' from escaping therefrom with the hulls.

As described above, the conventional closed winnowing system K' has three outlets: "the first outlet 24 where winnowed grains fall"; "the second outlet 25 where lightweight particles being blown up fall"; and "the third outlet 26 where hulls being blown away fall". As the lightweight particles such as crashed grains and fruitlessness are sorted as a group through the second outlet 25, for the closed winnowing system K' to perform such separation or selection reliably, it is necessary to keep the flow rate of air as the winnowing wind relatively small for delicate air flow control. As a result, the separation capacity of the winnowing room A is limited to a relatively small level. This has been a disadvantage that limits a winnowing process capacity of the plant.

In recent years, the necessity of the closed winnowing system to separate fruitless and crashed grains from others has declined as mentioned previously.

Therefore, to overcome the above mentioned disadvantage, the present invention provides a closed winnowing system K that has only two outlets, which are embodied, respectively, as a "winnowed grain conveyor 1 where winnowed grains fall" and "a hull conveyor 2 where hulls are blown away and fall". To reduce the number of separated groups from three to two, the closed winnowing system K according to the present invention has gone through some improvements, which are described in the following paragraphs.

According to the present invention, since the two outlets of the closed winnowing system K are embodied as "the winnowed grain conveyor 1 where winnowed grains fall" and "the hull conveyor 2 where hulls are blown away and fall", the grain husking-and-winnowing plant includes, as shown in FIG. 19, neither the poor-grain reservoir 9 nor the winnower rebound elevator 16, which exists in the above described conventional plant shown in FIG. 20.

The greatest advantage of the present invention is that a processing ability of the closed winnowing system K can be increased to a substantially higher level.

FIG. 21 shows the specific construction of the conventional closed winnowing system K', which is included in FIG. 20. It is clearly understood from this drawing that the conventional closed winnowing system K' has three outlets: "the first outlet 24 where winnowed grains fall"; "the second outlet 25 where lightweight particles being blown up fall"; and "the third outlet 26 where hulls being blown away fall".

In the conventional closed winnowing system K', the winnowing room A' includes a winnowing passage with a first wind amount adjustment shutter 51 for the first outlet 24 and a second wind amount adjustment shutter 52 for the second outlet 25. In other words, in the conventional winnower, the air flow to lead the fall of the winnowed grains into the first outlet 24 must be adjusted by the first wind amount adjustment shutter 51, while the wind amount to lead the fall of the lightweight crashed or fruitless grains into the second outlet 25 must be adjusted by the second wind amount adjustment shutter 52. Such wind amount adjustment shutters are not provided in the vicinity of the winnowing fan F or of the blowing room B.

The conventional closed winnowing system K' is so designed that the opening of these shutters 51 and 52 must be adjusted by an operator. To operate the separator and to attain a best result, it has been necessary to station a specially trained skilled operator, who makes fine and difficult adjustment on the opening of the first wind amount adjustment shutter 51 and the opening of the second wind amount adjustment shutter 52.

Figure 6:
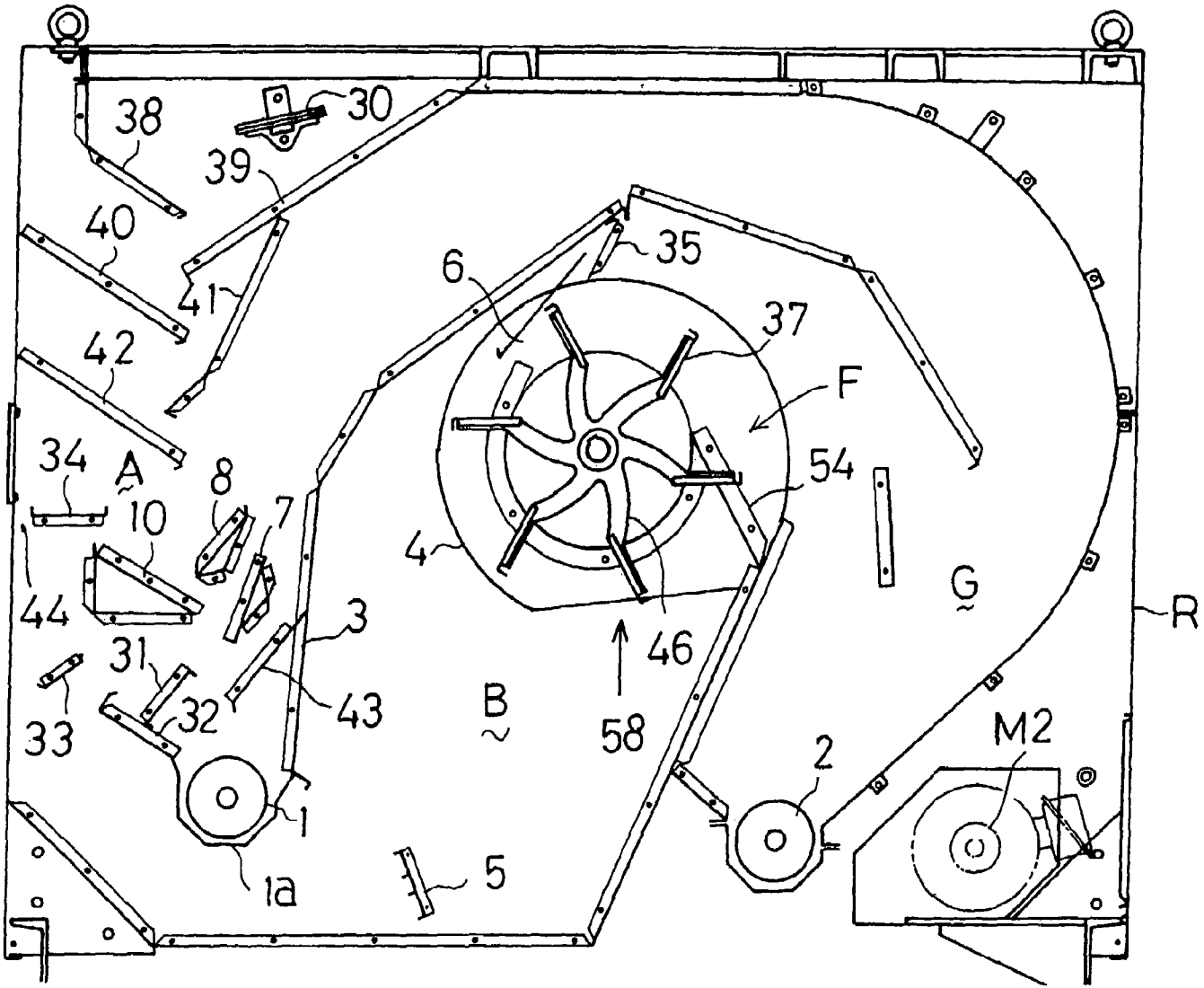
FIG. 6 is a sectional view showing a winnowing wind passage of the closed winnowing system.

In contrast to the conventional winnowing system, the closed winnowing system K according to the present invention has only "a winnowed grain conveyor 1 where winnowed grains fall" below the wind-powered separation room A, as shown in FIG. 6. There is no conveyor that represents the second outlet of the conventional winnower. In other words, in this part of the winnower, no separation is executed to differentiate the "winnowed grains" from the "lightweight fruitlessness and crashed grains".

Accordingly, there is no need to provide the first wind amount adjustment shutter 51 and the second wind amount adjustment shutter 52 of the conventional winnower in the winnowing room A of the winnower according to the present invention.

Instead, the winnowing system K according to the present invention has winnowing wind shutters 6 to adjust the degree of separation between "the winnowed grain conveyor 1 where winnowed grains fall" and "the hull conveyor 2 where hulls are blown away and fall". These shutters 6 are provided near the winnowing fan F, which is located at the upper part of the blowing room B. With this construction, unwanted part of the winnowing wind is bypassed and discharged from the blowing room B to a hull blowing wind passage G by the adjustment of the shutters 6.

Figure 1:
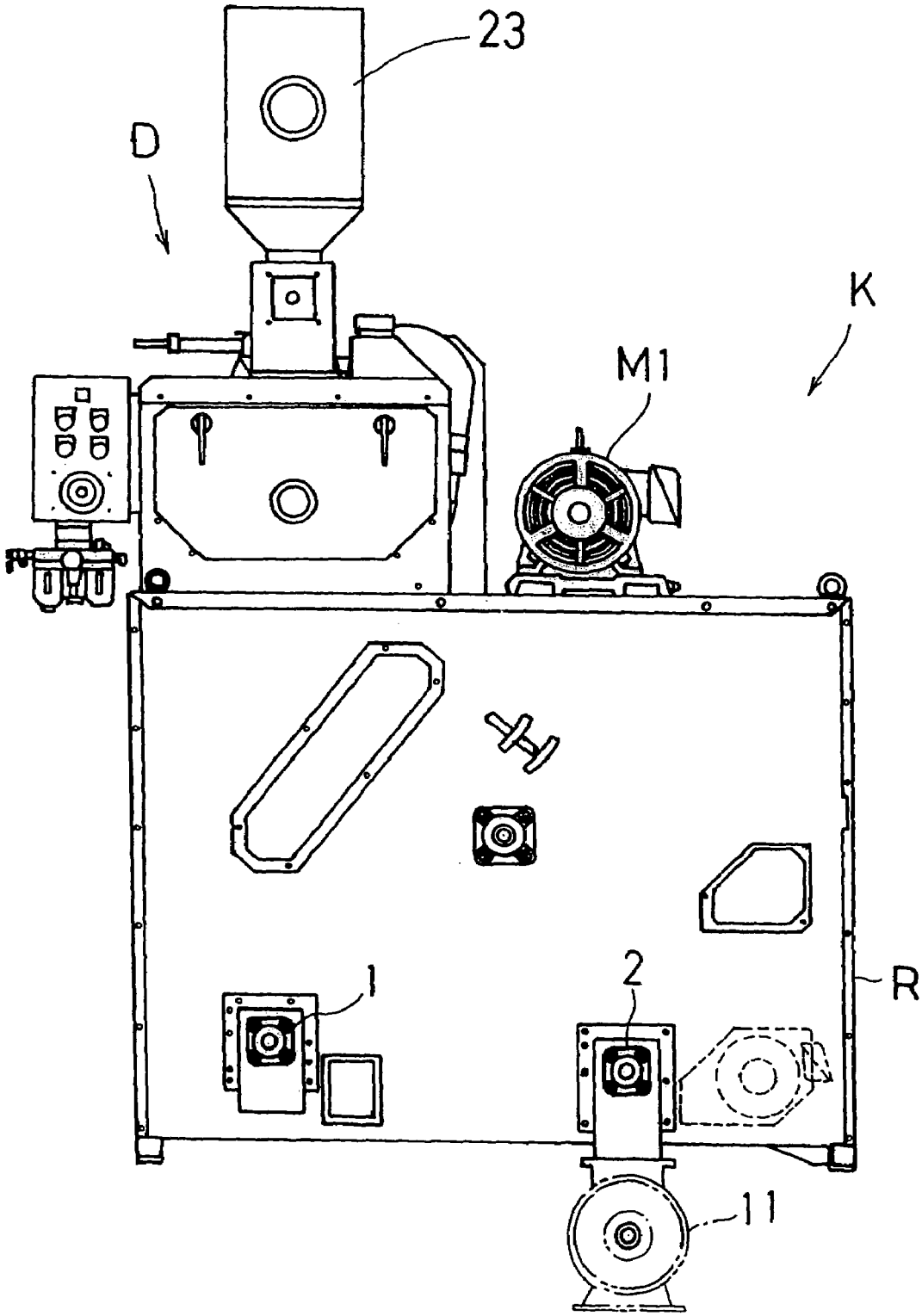
FIGS. 1, 2 and 3 are, respectively, a front view, a left side view and a right side view of the whole of a closed winnowing system according to the present invention, which is equipped with a husking unit D.
Figure 2:
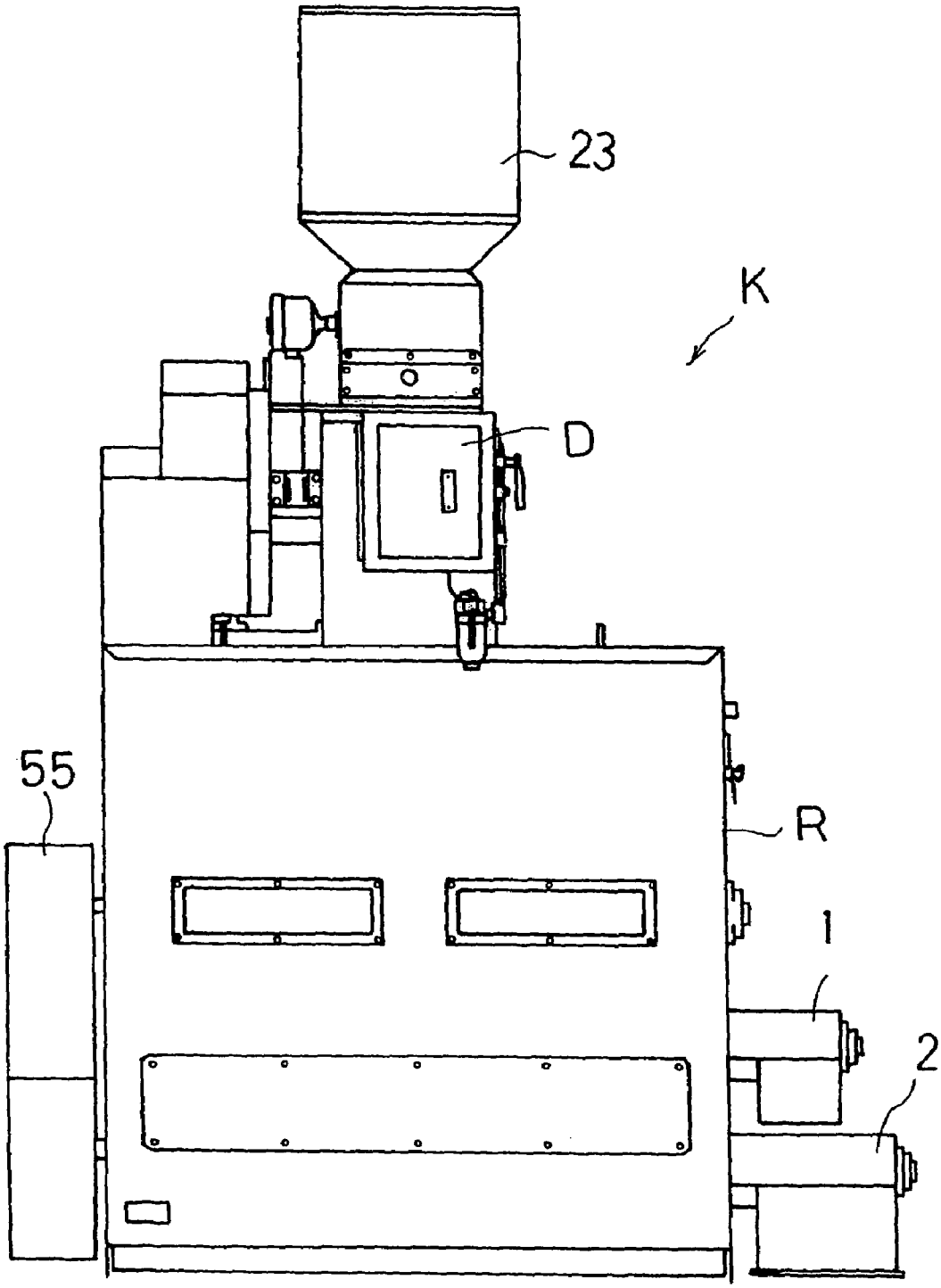
Figure 3:
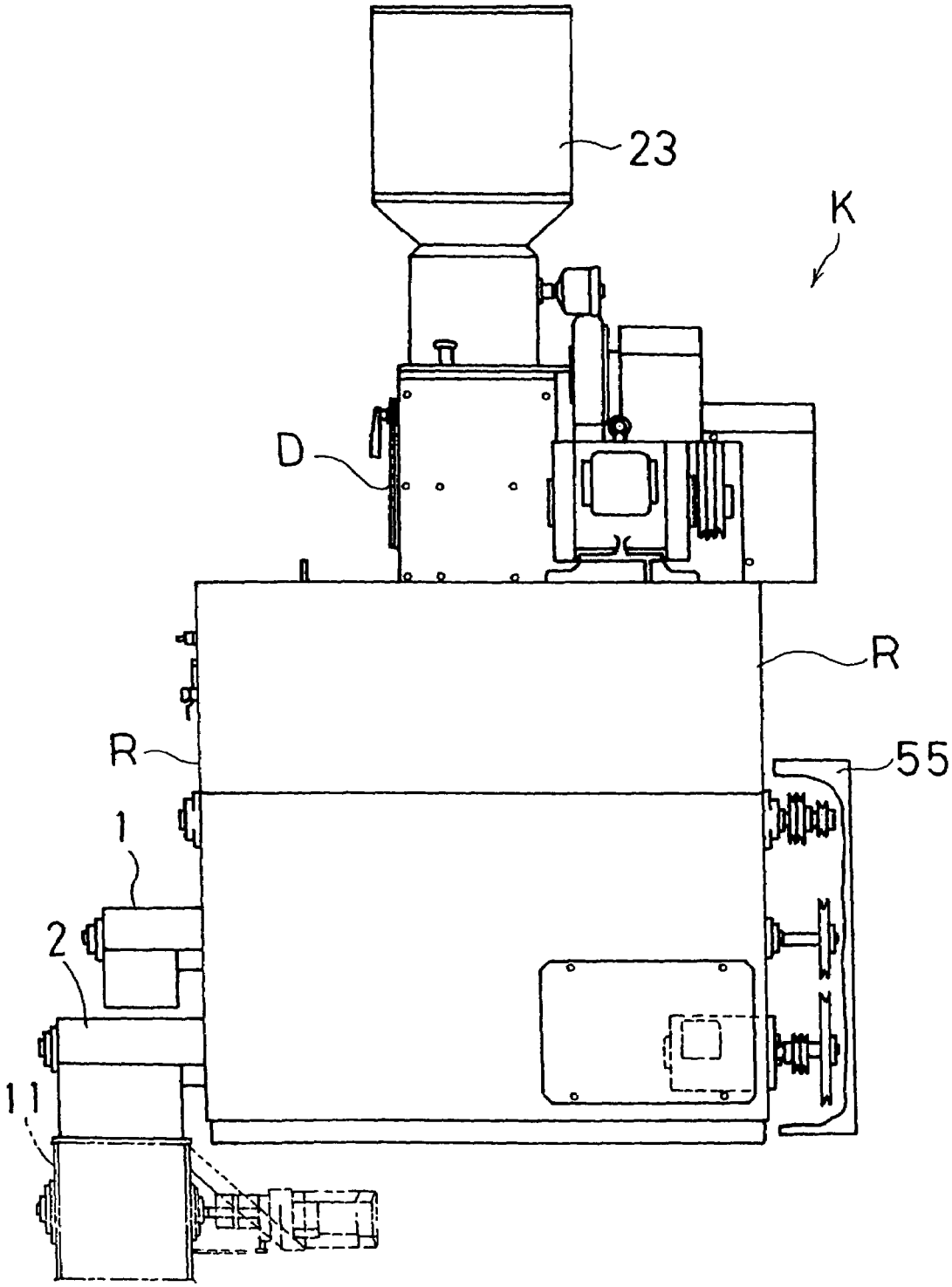

Now, with reference to FIGS. 1 to 3, a description is given of the whole construction of the closed winnowing system K according to the present invention.

As shown in FIG. 1 and the like, the closed winnowing system K mainly comprises a closed housing R which is located at the bottom, a husking unit D which is set on the closed housing R, and a hopper 23 which is mounted on the husking unit D. In addition, a hull shutter 11 is provided at a location where the hull conveyor 2 extrudes from the closed housing R. The closed housing R includes a winnowing room A, a blowing room B and winnowing fans F; which are important components of the present invention.

On the closed housing R and near the husking unit D, a husking drive motor M1 is provided to power the husking unit D.

Figure 4:
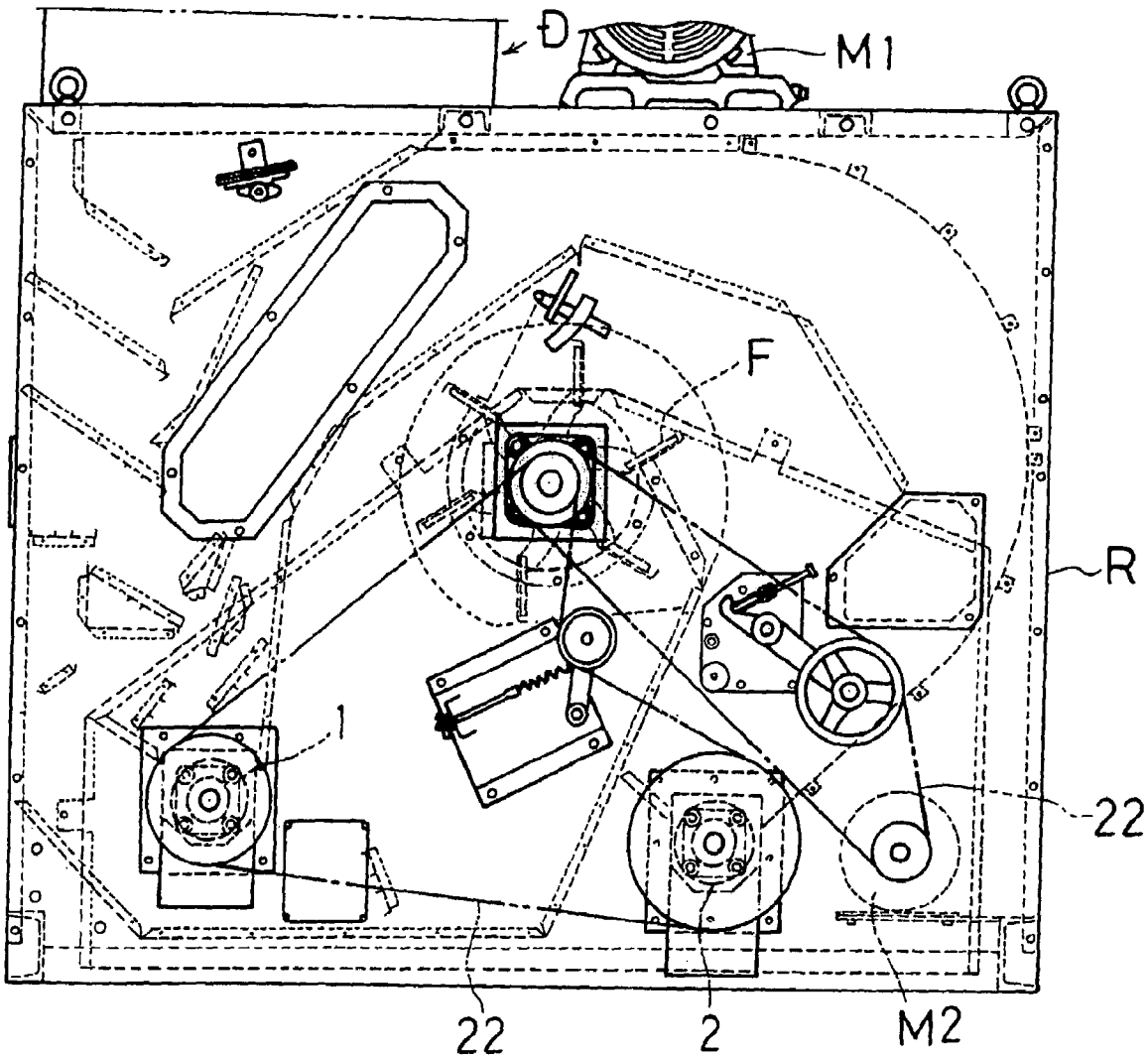
Figure 5:
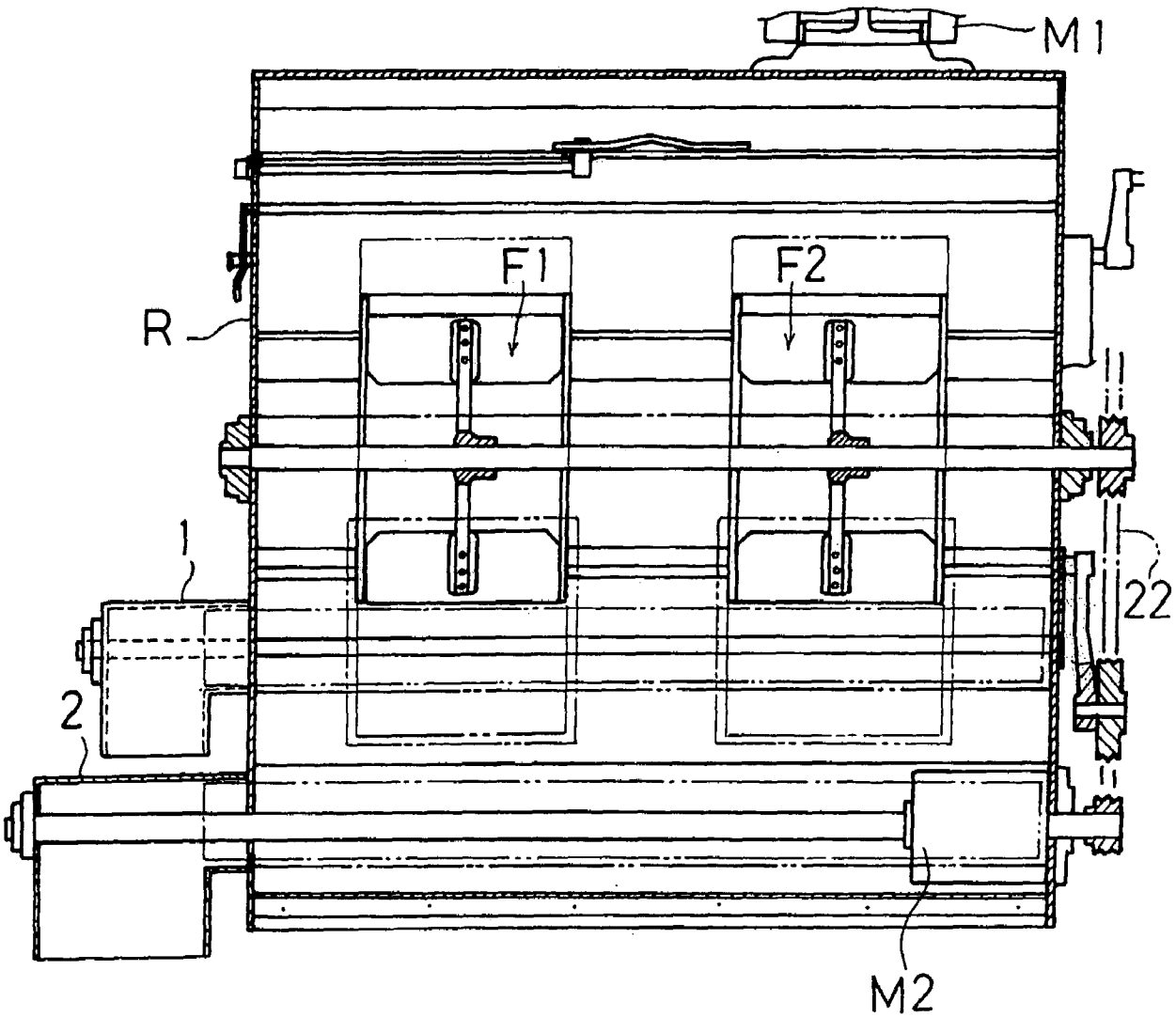
FIG. 5 is a sectional right side view of the same. Furthermore.

FIGS. 4 and 5 show specifically the construction of the closed housing R. As shown in these drawings, in addition to the husking drive motor M1, a winnowing drive motor M2, which powers the winnowing fans F, the winnowed grain conveyor 1 and the hull conveyor 2, is provided in the closed housing R.

FIG. 5 is a sectional view taken along a plane that passes through the winnowing fans F. It is clear from this view that the winnowing fans F comprise left and right fans F1 and F2.

Figure 7:
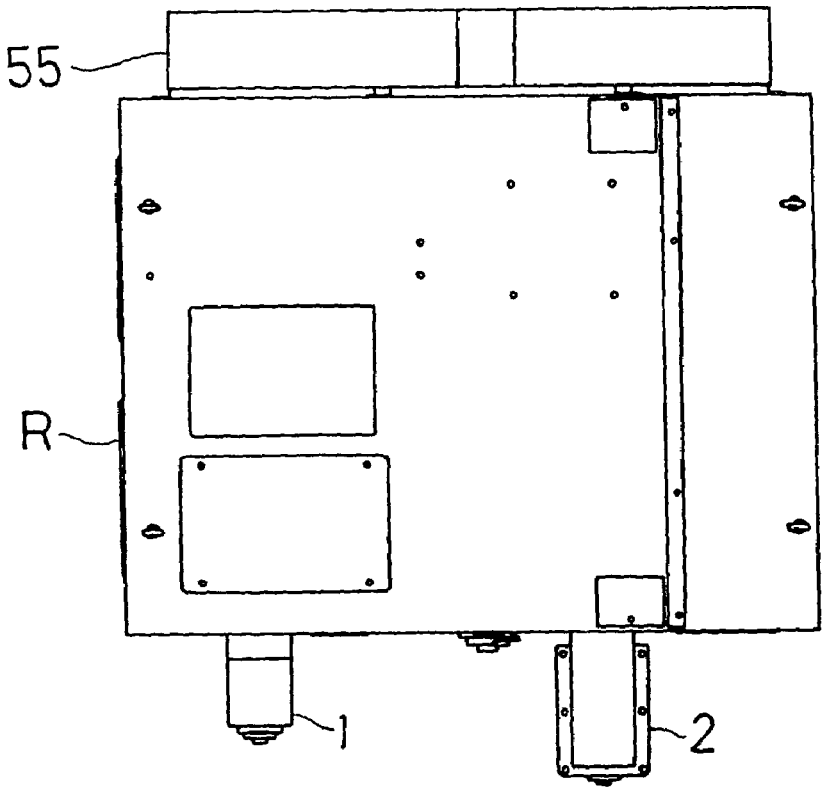
FIGS. 7, 8, 9, 10, 11 and 12 are, respectively, a plan view, a front view, a bottom view, a right side view, a left side view and a rear view showing only the closed winnowing system.
Figure 8:
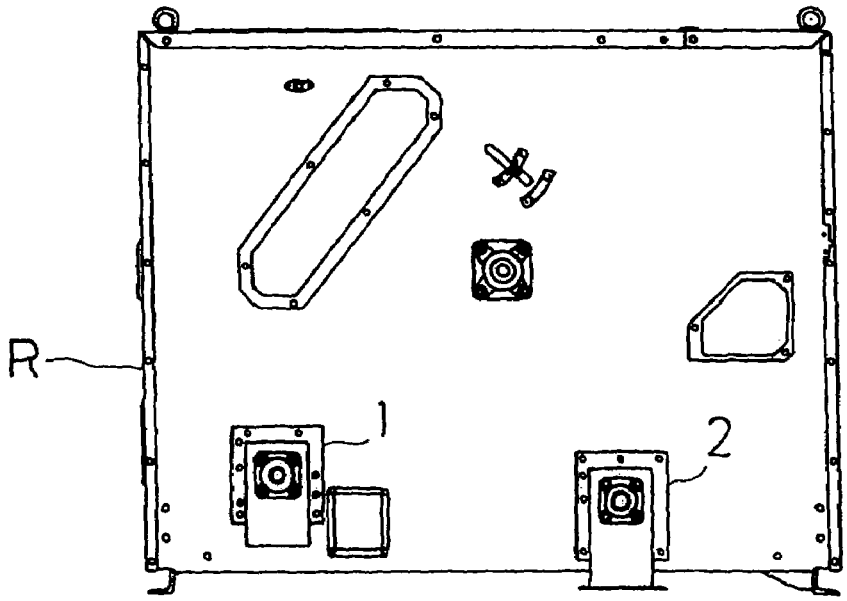
Figure 9:
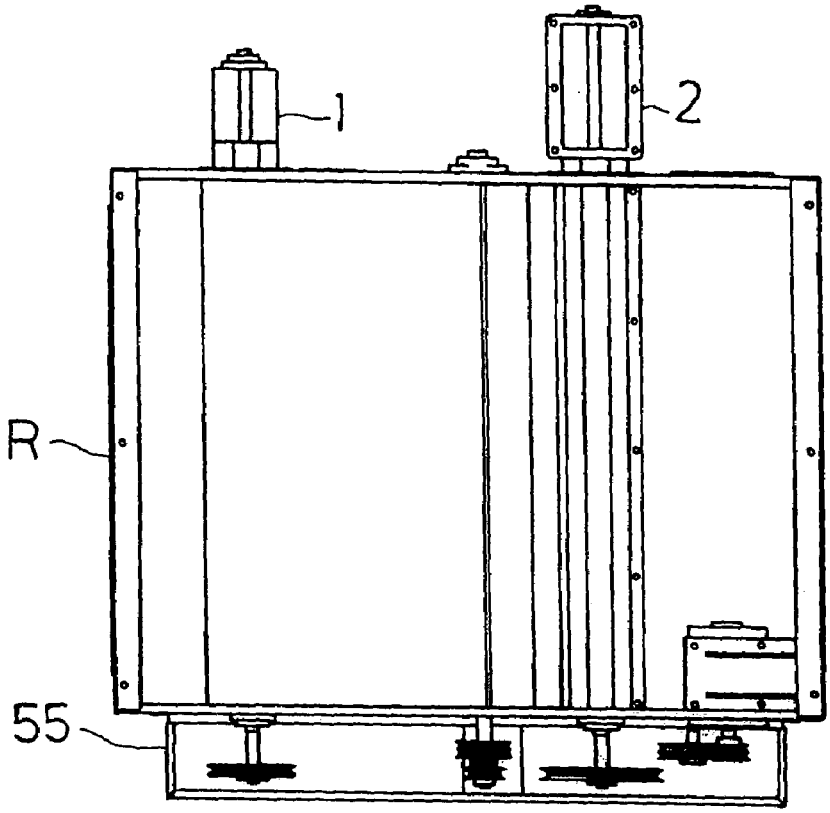
Figure 10:
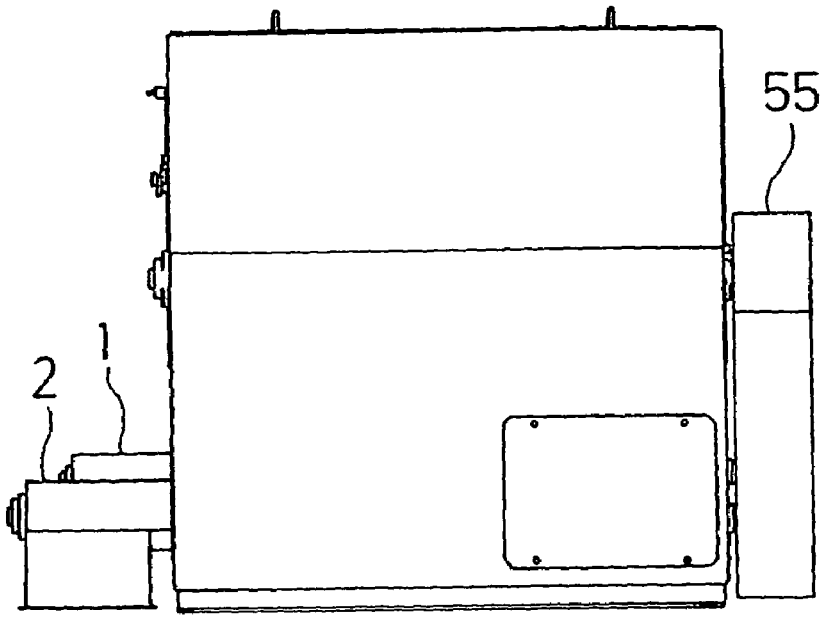
Figure 11:
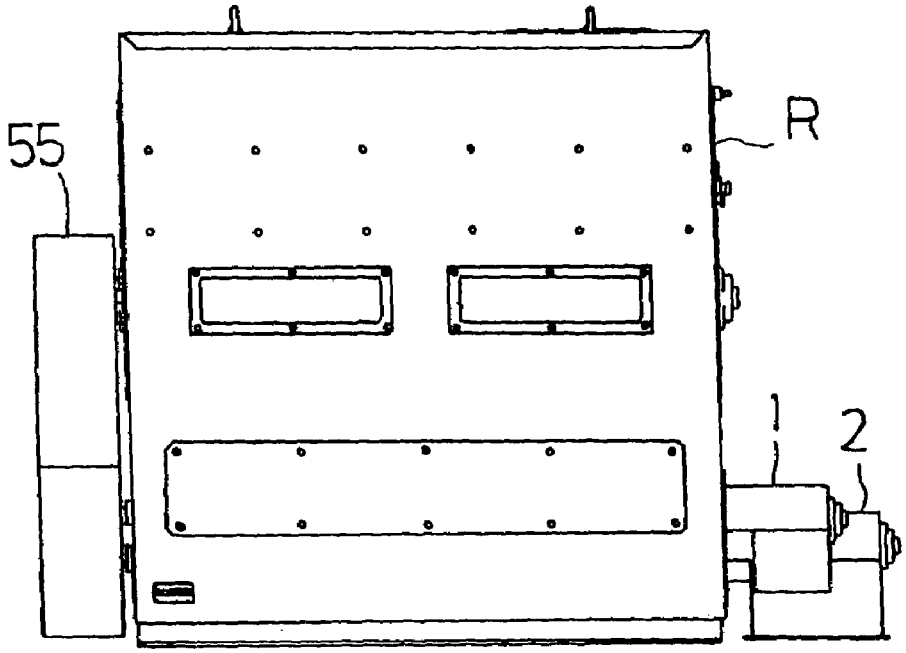
Figure 12:
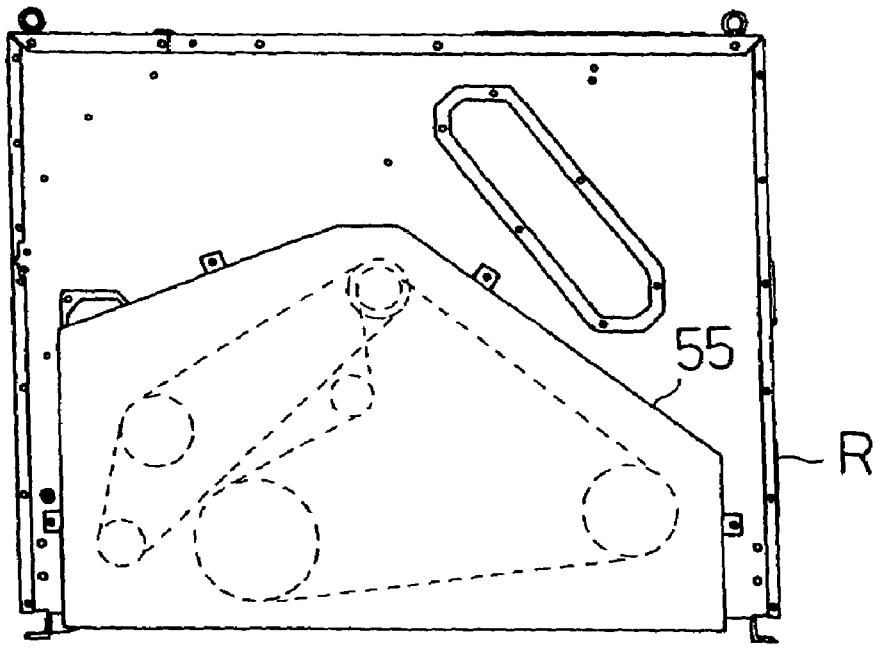

FIGS. 7 to 12 are six surfaces views of the closed housing R drawn in an identical scale, which are taken along the directions of the six surfaces of the closed housing R. The positional relation of "the winnowed grain conveyor 1 where winnowed grains fall" and "the hull conveyor 2 where hulls are blown away and fall" and the heights of these conveyors are clearly understandable from these views. As shown in FIG. 7 and in FIGS. 10 to 12, a belt cover 55 is attached on the rear side of the closed housing R to cover a V belt 22. The V belt 22 transmits power from the winnowing drive motor M2 to the winnowed grain conveyor 1, the hull conveyor 2 and the winnowing fans F.

FIGS. 13 to 16 show, in detail, the construction of the winnowing fans F, which are provided in the closed housing R.

The winnowing fans F are embodied in two pieces, i.e., the left fan F1 and the right fan F2, because the closed housing R is relatively wide. The winnowing fans F are impellers having vanes 37. Each of fans F1 and F2 is provided with a vane supporter 46 to which six vanes 37 are fitted so as to generate a sizable wind amount.

The winnowing fans F of the closed winnowing system according to the present invention have the following features. Three winnowing wind intake ports 56 are provided, one between left and right fan housings 4, which accommodate the left and right fans F1 and F2 respectively, and the other two on the left and right outer sides of the respective fan housings 4. Furthermore, three back flow blocking plates 54 are provided below the winnowing wind intake ports 56 to prevent the winnowing wind from returning to the hull blowing wind passage G through this section.

Moreover, three winnowing wind shutters 6 are provided above the respective winnowing wind intake ports 56 and beside the left and right fans F1 and F2. The winnowing wind shutters 6 are connected with one another and are rotatably adjusted as a one-piece body.

In addition, winnowing wind back flow preventing plates 35 are provided to shut the openings that exist above the fan housings 4 and thereby preventing a back flow of air from the blowing room B to the hull blowing wind passage G through this section.

In this construction, the winnowing wind is generated and sent downward from the left and right fans F1 and F2. With the winnowing wind blowing, the rotation, i.e., the movement upward or downward, of the winnowing wind shutters 6 determines the flow of the air returning from the blowing room B to the hull blowing wind passage G, which, in turn, adjusts the wind amount into the winnowing room A.

In other words, the present invention has made it possible to adjust the winnowing wind flowing from the winnowing fans F to the winnowing room A only with the winnowing wind shutters 6. This way of adjustment is different from that of the prior art, which adjusts the winnowing wind that is supplied once into the direction of the winnowing room A', separately with the first wind amount adjustment shutter 51 and with the second wind amount adjustment shutter 52 as shown in FIG. 21.

In the closed winnowing system according to the present invention, the above mentioned three winnowing wind intake ports 56, which are provided near the left and right fans F1 and F2, are open in the direction of the hull blowing wind passage G as shown in FIGS. 13 to 16.

Therefore, the air in the hull blowing wind passage G is taken in through the winnowing wind intake ports 56 from the sides of the left and right fans F1 and F2 and discharged as the winnowing wind through discharge openings 58, which are located under the fans F1 and F2.

Figure 13:
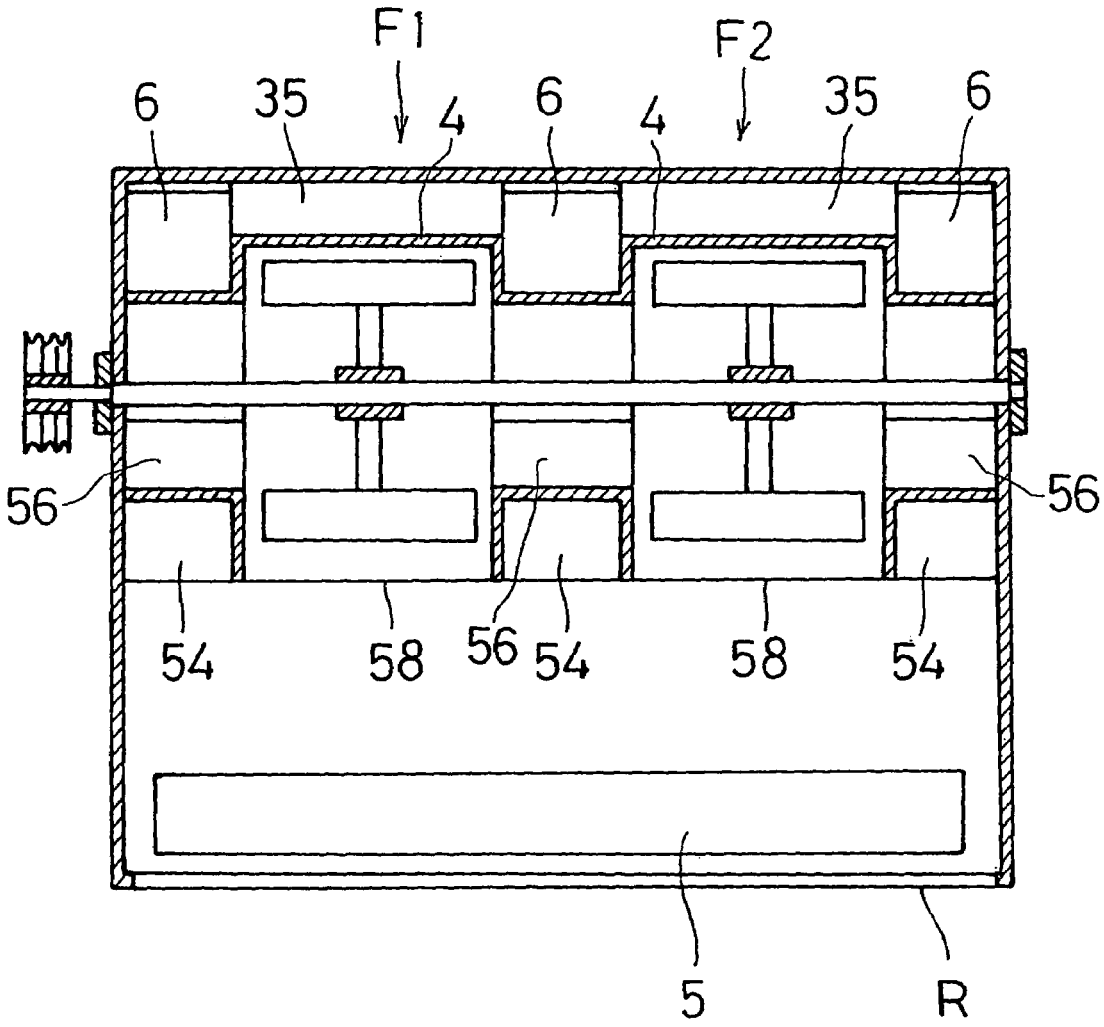
FIG. 13 is a sectional side view of a part of the closed winnowing system in which winnowing fans F, a blowing room B, winnowing wind shutters 6 and back-flow shield plates 45 are provided.
Figure 14:
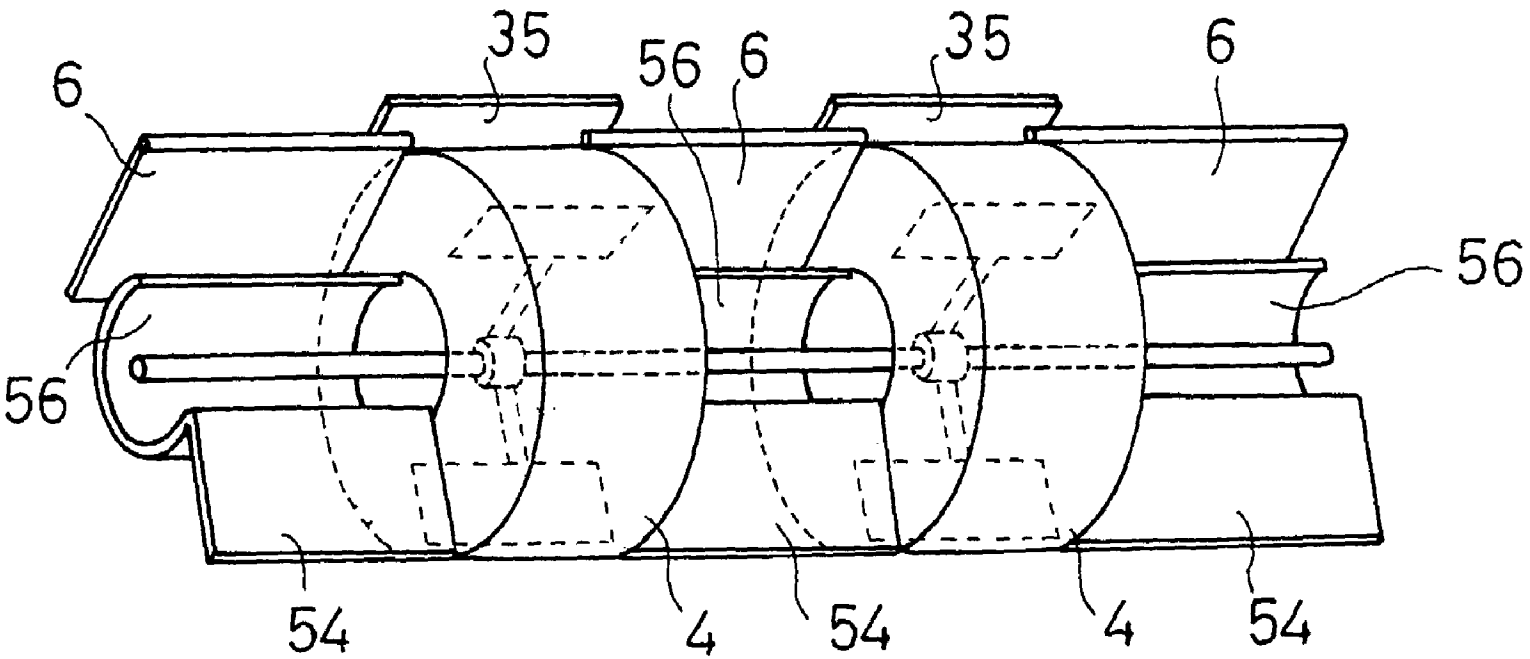
FIG. 14 is a perspective view of the same.
Figure 15:
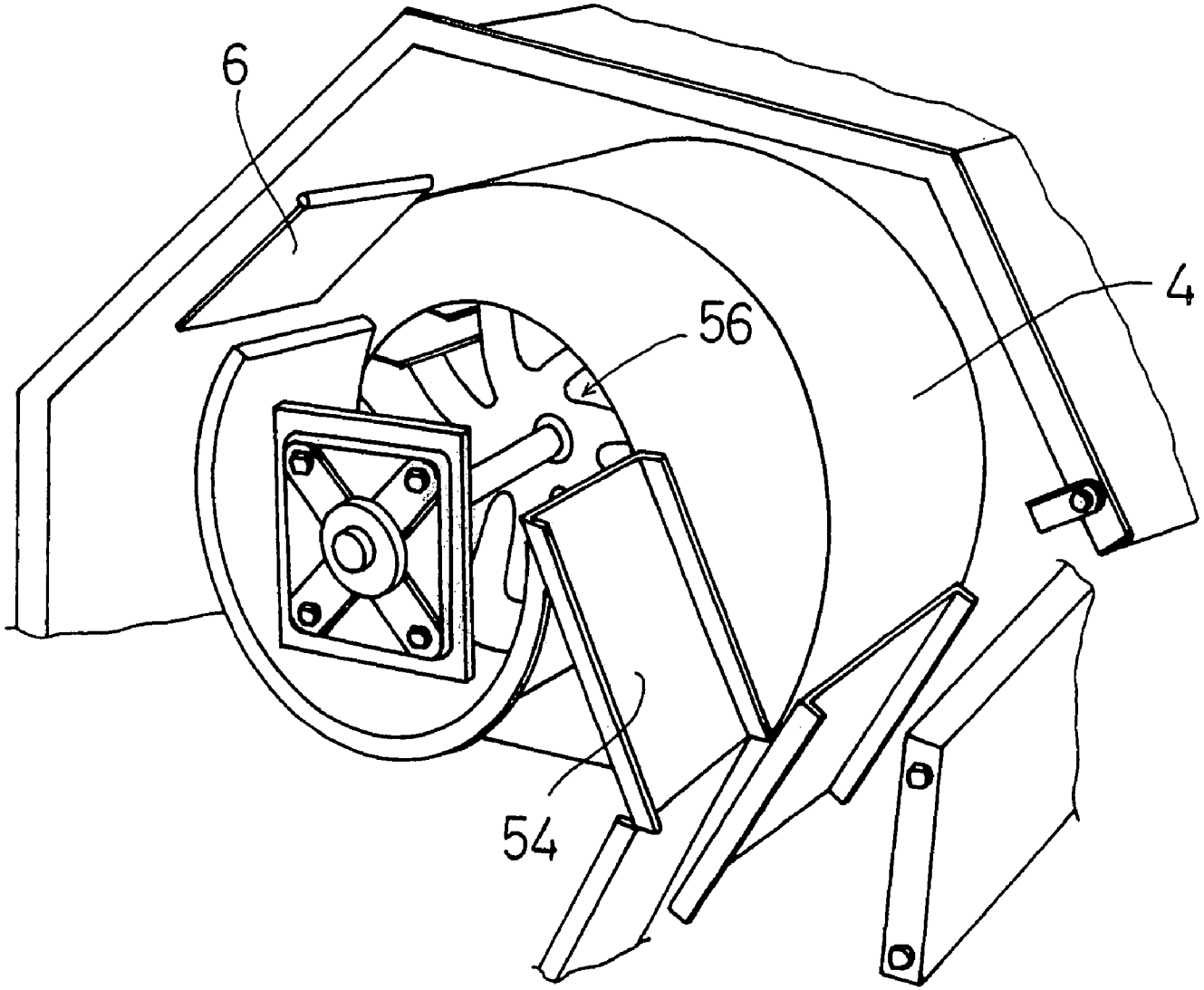
FIG. 15 is a perspective view of a part of the same of FIG. 14 showing a state of opening the separating shutter 6.
Figure 16:
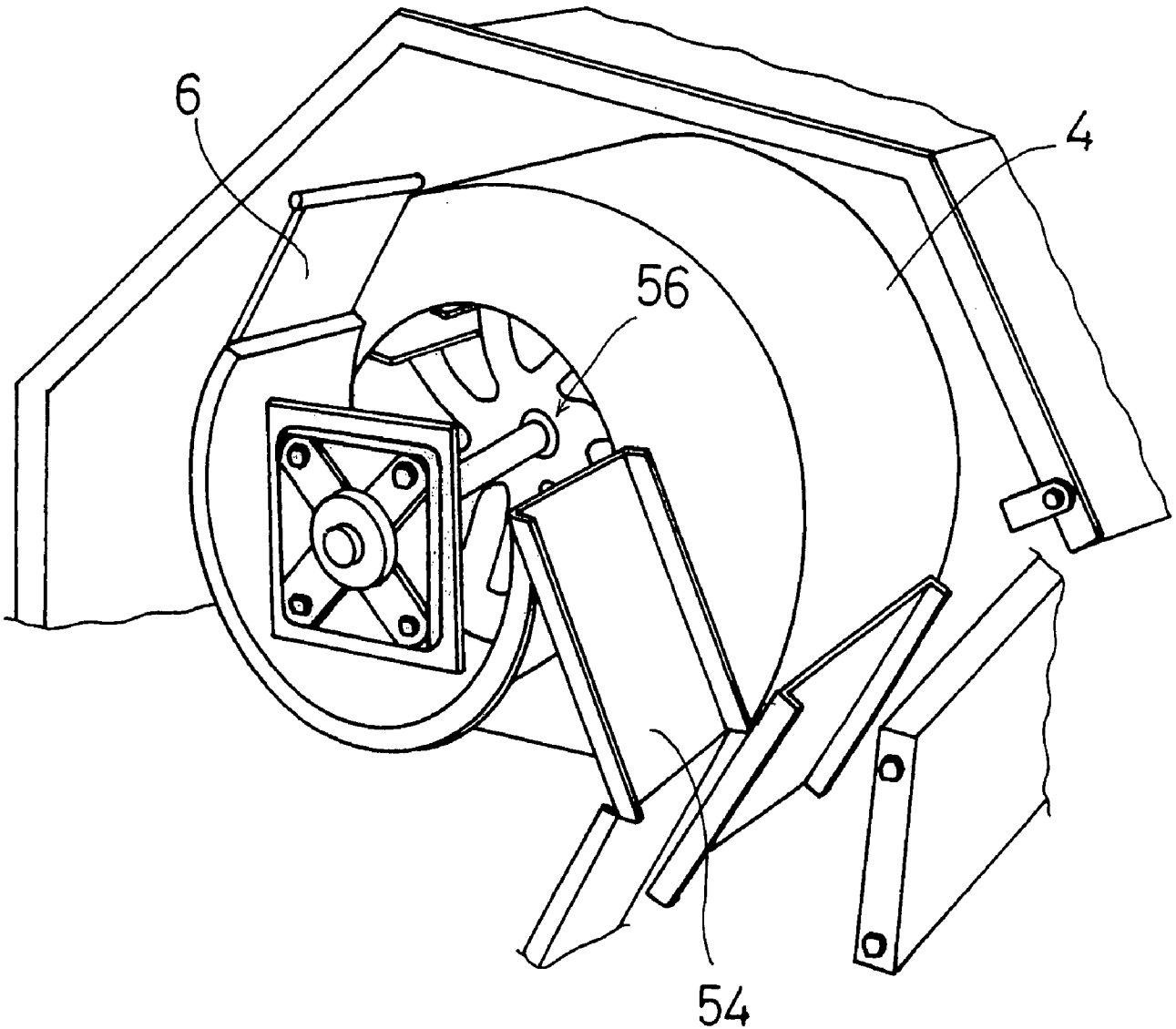
FIG. 16 is a perspective view of the same showing a state of closing the winnowing wind shutters 6.

As shown in FIG. 6 and FIG. 13, a winnowing wind direction adjusting plate 5 is provided below the left and right fans F1 and F2 and above a bottom plate, slantingly with the upper edge thereof toward the winnowing room A. In this way, the winnowing wind discharged from the fans F1 and F2 hits the winnowing wind direction adjusting plate 5 so as to become evenly distributed widthwise.

Now, the winnowing room A and the blowing room B are described generally in reference to FIG. 6.

Although FIG. 6 does not show the husking unit D, which is mounted on the closed housing R and includes the left and right husking rolls 20 and 21 shown in FIG. 21, grains are husked by the husking rolls 20 and 21, and resultant grains and hulls fall downward. Entering the closed housing R, the grains and hulls hit, at first, a collision plate 30 shown in FIG. 6, and then, fall along a zigzag course that is defined by five grain-flow plates, three of them 38, 40 and 42 positioned on the left and the other two 39 and 41 on the right in FIG. 6.

The winnowing room A is located under the grain-flow plate 42, which is positioned on the left hand. In the winnowing room A, a horizontally arranged air-course blocking plate 34, a left-side triangular grain-flow wind-blocking plate 10, an outward grain-flow plate 31 and a final grain-flow plate 32 are provided on the left side in this downward order. The left-side triangular grain-flow wind-blocking plate 10 is arranged in a right-angled-triangular form to lead the winnowed grains to the winnowed grain conveyor 1. The final grain-flow plate 32 is arranged so as to lead the winnowed grains to the winnowed grain conveyor 1 finally. The outward grain-flow plate 31 is positioned above the final grain-flow plate 32 and arranged to direct the winnowed grains outwardly.

Also, in the winnowing room A, a right-side upper triangular grain-flow wind-blocking plate 8, a right-side lower triangular grain-flow wind-blocking plate 7 and an inward grain-flow plate 43 are provided on the right side in this downward order. The right-side upper and lower triangular grain-flow wind-blocking plates 7 and 8 are arranged in triangular forms to lead the winnowed grains to the winnowed grain conveyor 1. The inward grain-flow plate 43 is arranged substantially parallel with the outward grain-flow plate 31 so as to lead the winnowed grains to the winnowed grain conveyor 1. The upper edge of the inward grain-flow plate 43 is fixed on a vertical shield plate 3.

In this arrangement, the winnowing wind, after being generated by the winnowing fans F hits the winnowing wind direction adjusting plate 5 in the blowing room B and then flows through the opening between the bottom of a conveyor gutter 1*a* which constitutes the winnowed grain conveyor 1 and the bottom plate of the closed housing R. Then, the winnowing wind flows through the passage located below the final grain-flow plate 32 into the winnowing room A.

A wind direction adjusting plate 33 is provided above the final grain-flow plate 32 in the winnowing room A. By this wind direction adjusting plate 33 and the above mentioned horizontal air course blocking plate 34, the winnowing wind is divided into two directions, one toward the outward grain-flow plate 31 and the other toward the left-side triangular grain-flow wind-blocking plate 10.

Then, part of the winnowing wind passes through an opening 44 between the horizontal air course blocking plate 34 and an inner side-wall of the closed housing R, and part of the winnowing wind also passes through the opening between the left-side triangular grain-flow wind blocking plate 10 and the grain-flow plate 42.

On the left side of the falling grain passage in the closed housing R, the winnowing wind flows through two winnowing wind passages. One flow passes between the grain-flow plate 42 and the left-side triangular grain-flow wind blocking plate 10 and the other flow passes between the left-side triangular grain-flow wind blocking plate 10 and the outward grain-flow plate 31.

On the right side of the falling grain passage in the closed housing R, the winnowing wind that has passed through the two winnowing wind passages located on the left-side now flows through three winnowing wind passages. One flow passes between the grain-flow plate 42 and the right-side upper triangular grain-flow wind blocking plate 8, another flow passes between the right-side upper triangular grain-flow wind-blocking plate 8 and the right-side lower triangular grain-flow wind-blocking plate 7, and the other flow passes between the right-side lower triangular grain-flow wind blocking plate 7 and the inward grain-flow plate 43.

The winnowing wind flowing through these passages blows upward the hulls that have fallen into the closed housing R and carries the hulls into the hull blowing wind passage G.

The winnowing wind that has reached the hull blowing wind passage G is taken in again through the winnowing wind intake ports 56, which are located on the sides of the left and right fans F1 and F2, and recirculated by the fans F1 and F2 from the blowing room B to the winnowing room A.

According to the present invention, the winnowing room A and the blowing room B of the closed winnowing system are positioned next to each other with the vertical shield plate 3 partitioning these two rooms. The above mentioned winnowed grain conveyor 1 is placed at the bottom of the winnowing room A, which is arranged vertically along the vertical shield plate 3. In this construction, the winnowing fans F placed in the blowing room B generate and supply the winnowing wind from the blowing room B through the opening provided under the winnowed grain conveyor 1 to the bottom of the winnowing room A, where the winnowing wind now flows upward.

Since the winnowing wind is directed upward, the grains are winnowed so as to be separated from the hulls in a most efficient and accurate way.

Figure 17:
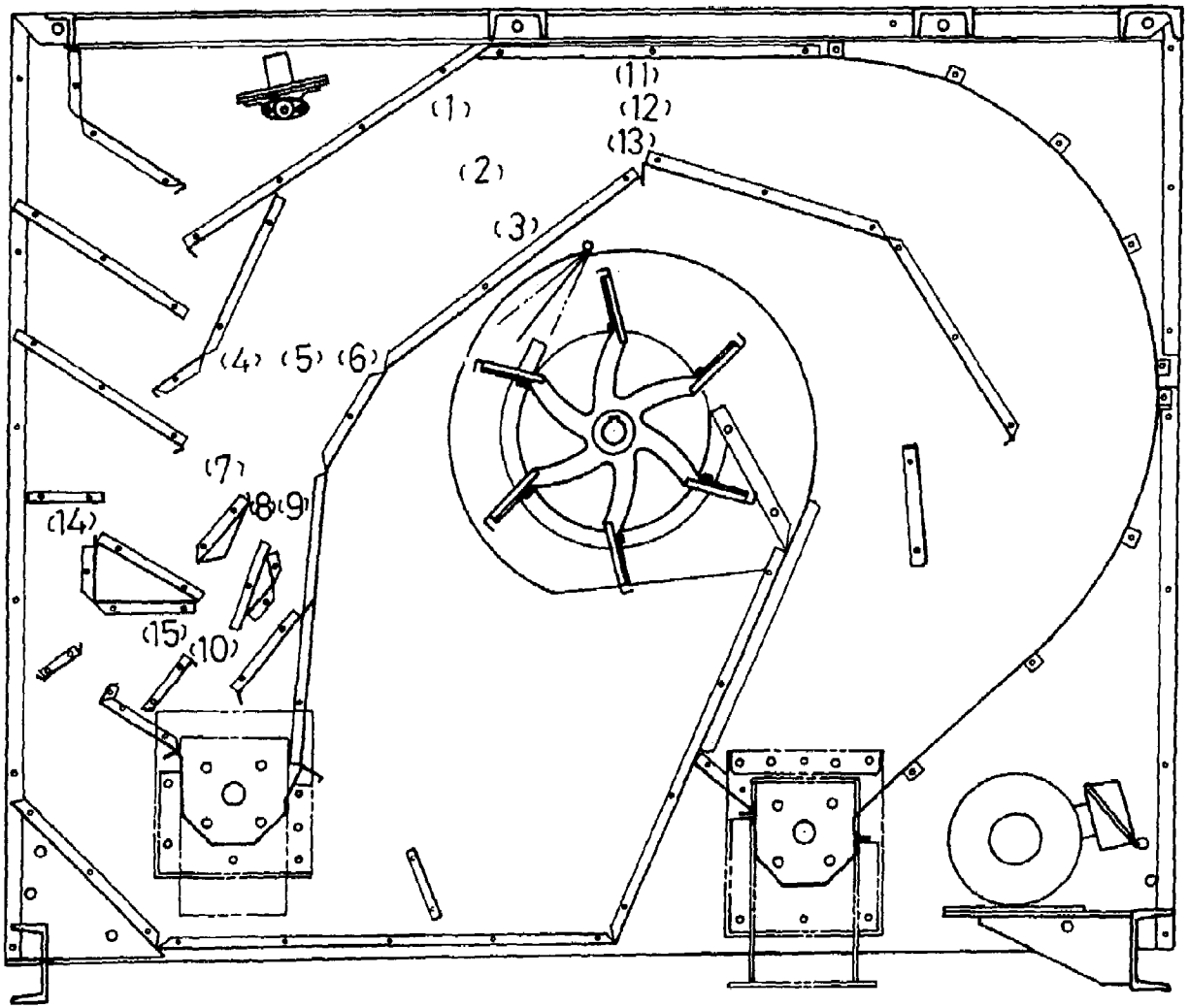
FIG. 17 indicates measurement points of a wind amount and a wind speed provided in the closed winnowing system.
Figure 18:
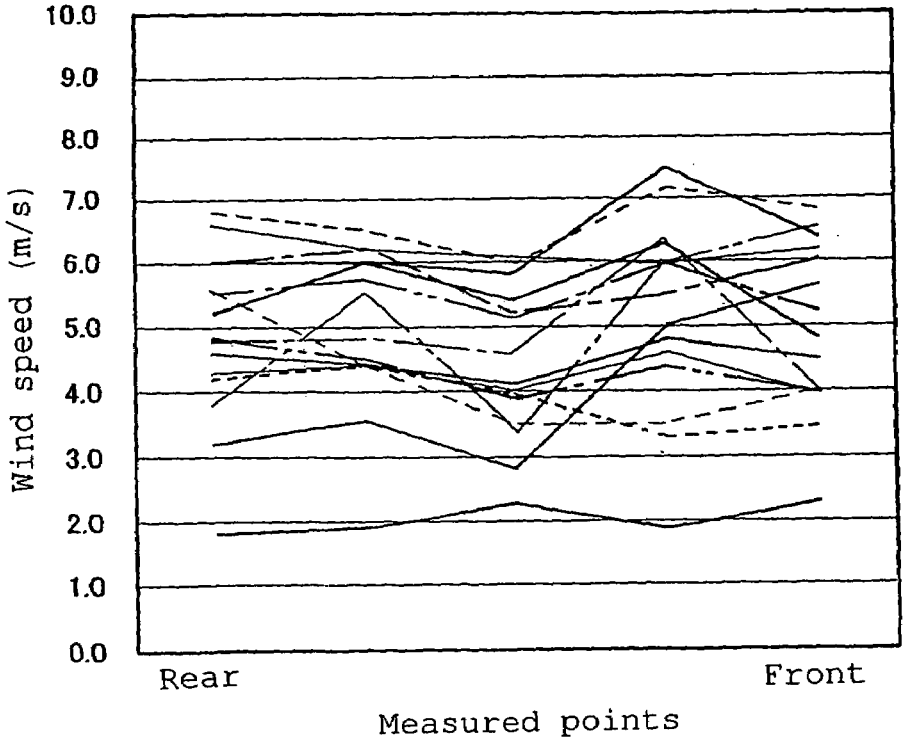
FIG. 18 shows the wind speed in the measuring points of FIG. 17.

FIG. 17 shows points in the winnowing room A where air flow is measured, and FIG. 18 shows measured values of the winnowing wind from front side to rear side of the closed housing R in each measuring point.

As previously mentioned, since the winnowing wind direction adjusting plate 5 is provided below the winnowing fan F in the blowing room B, the flow of the winnowing wind is uniform throughout the width of the closed housing R, i.e. from the front side to the rear side, as shown in the graph of FIG. 18.

In the present invention, the closed housing R includes the horizontal air course blocking plate 34, the left-side triangular grain-flow wind blocking plate 10, the outward grain-flow plate 31 and the final grain-flow plate 32 on the left side of the lower end of the grain-flow plate 42, and the right-side upper triangular grain-flow wind blocking plate 8, the right-side lower triangular grain-flow wind blocking plate 7 and the inward grain-flow plate 43 on the right side of the lower end of the grain-flow plate 42. As a result, the winnowing wind flows through the two passages defined by these plates on the left side and then flows through the three passages defined by these plates on the right side. While the winnowing wind is dispersed through these winnowing wind passages in this way, the wind speed at each point is maintained substantially constant, with speed values at the measured points (7), (8), (9), (10), (14) and (15) being approximately 4 to 7 m/s, respectively, though the flow amount is different as described below. In this arrangement, grains after being husked are exposed to the winnowing wind at a number of steps to make accurate the separation of the grains from the hulls.

FIG. 22 shows the flow amount measured at each point. The flow amount differs as listed in the table, however there isn't much difference in the wind speed as shown in FIG. 18 since the closed winnowing system according to the present invention is designed to keep the wind speed substantially constant.

Further, according to the present invention, the grain-flow plate 42, the left-side triangular grain-flow wind-blocking plate 10, the horizontal air course blocking plate 34, the right-side upper triangular grain-flow wind blocking plate 8, the right-side lower triangular grain-flow wind blocking plate 7, the inward grain-flow plate 43, the final grain-flow plate 32, etc., which are provided in the wind-powered separation room A, are made of abrasion resistant materials such as stainless steel to minimize the abrasion caused by particles of silicon included in grains.

INDUSTRIAL APPLICABILITY OF THE INVENTION

As mentioned above, a structure of the present invention is usable for a closed winnowing system for selecting and sorting winnowed grains and hulls after husking, and specially suitable for improving a winnowing process capacity of grains.

What is claimed is:

1. A closed air force type grain sorting mechanism comprising:

a grain dropping passage constituted below a husking unit, said grain dropping passage serving as a winnowing room;

a winnowing fan blowing a winnowing wind into the winnowing room so as to winnow grains dropped from said husking unit;

a plurality of winnowing wind guide plates provided in said winnowing room, wherein the plurality of winnowing wind guide plates are constituted in a triangular shape in a sectional viewing and arranged so as to collide with said grains dropped after husking;

a winnowed grain conveyor positioned below the winnowing room;

a wind direction adjusting plate constituted in a triangular shape;

a grain-flow plate provided in between the wind direction adjusting plate and the winnowed grain conveyor;

a plate provided in the winnowing room configured to deflect winnowing wind toward the grain-flow plate; and a hull conveyor positioned in a reverse side of the winnowing room with respect to said winnowing fan, wherein said winnowed grain conveyor serves as the sole conveyor positioned below said winnowing room so that the grains mixed with hulls and others falling in said winnowing room from said husking unit are sorted into two kinds, winnowed grains to be received by the winnowed grain conveyor, and the other including hulls to be received by the hull conveyor.

2. The closed air force type grain sorting mechanism as set forth in claim 1, further comprising.

a blowing room through which said winnowing fan blows the winnowing wind to the lower end of said winnowing room, said blowing room being located adjacent to said winnowing room; and a shield plate vertically constituted between said winnowing room and said blowing room so as to partition said two rooms, said winnowing room being arranged along said shield plate so as to be vertically linear, wherein said winnowing wind blown by said winnowing fan through said blowing room passes below said winnowed grain conveyor and rises in said vertically linear winnowing room for winnowing.

3. The closed air force type grain sorting mechanism as set forth in claim 1, further comprising:

a hull blowing wind passage to said hull conveyor; and a winnowing wind shutter for adjusting a wind speed and wind amount of a winnowing wind supplied to said winnowing room, wherein said winnowing wind shutter is provided in a passage returning a delivery wind of said winnowing fan to said hull blowing wind passage.

4. The closed air force type grain sorting mechanism as set forth in claim 2, further comprising:

right and left fans constituting said winnowing fan; and a winnowing wind direction adjusting plate positioned in a lower portion of said blowing room so that the winnowing wind from the winnowing fan is applied onto said winnowing wind direction adjusting plate.

5. The closed air force type grain sorting mechanism as set forth in claim 2, further comprising:

a winnowing wind shutter plate for adjusting a winnowing wind amount provided in a blow-off side of said winnowing fan so as to relieve the winnowing wind from the winnowing fan toward said hull conveyor.

* * * * *